US010704321B2

(12) United States Patent
Ohrstrom et al.

(10) Patent No.: US 10,704,321 B2
(45) Date of Patent: Jul. 7, 2020

(54) DOOR SWEEP

(71) Applicant: VISION EXTRUSIONS GROUP LIMITED, Woodbridge (CA)

(72) Inventors: Rolf Ohrstrom, Woodbridge (CA); Enzo Covello, Woodbridge (CA); Bruno Fortino, Woodbridge (CA)

(73) Assignee: Vision Extrustions Group Limited, Woodbridge (CA)

( * ) Notice: Subject to any disclaimer, the term of this patent is extended or adjusted under 35 U.S.C. 154(b) by 160 days.

(21) Appl. No.: 15/813,793

(22) Filed: Nov. 15, 2017

(65) Prior Publication Data

US 2019/0145159 A1 May 16, 2019

(51) Int. Cl.
*E06B 7/23* (2006.01)

(52) U.S. Cl.
CPC ..... *E06B 7/2316* (2013.01); *E06B 7/2312* (2013.01)

(58) Field of Classification Search
CPC ..... E06B 7/2312; E06B 7/2316
See application file for complete search history.

(56) References Cited

U.S. PATENT DOCUMENTS 3,448,543 A * 6/1969 Multer ..... E06B 7/2312 49/470
4,119,325 A 10/1978 Oakley et al.
5,174,065 A * 12/1992 Schlicht ..... E06B 7/2312 49/470
5,214,880 A * 6/1993 Woodruff ..... E06B 3/88 49/470
6,374,545 B1 4/2002 Baczuk
6,442,901 B1 9/2002 Rissone
7,829,174 B2 * 11/2010 Kanzaki ..... B32B 27/12 428/93
8,726,575 B1 * 5/2014 Vulpitta ..... E06B 7/22 49/470
9,062,490 B2 * 6/2015 Kadavy ..... E06B 7/16
D775,367 S * 12/2016 Mitchell ..... D25/48.2
D837,405 S * 1/2019 Greene ..... D25/48.2
2012/0079771 A1 * 4/2012 Meulemans ..... E06B 7/2305 49/484.1
2017/0342764 A1 * 11/2017 Headrick ..... E06B 1/70
2018/0163459 A1 * 6/2018 Mathieu ..... E06B 7/14

* cited by examiner

*Primary Examiner* — Catherine A Kelly
(74) *Attorney, Agent, or Firm* — Ohlandt, Greeley, Ruggiero & Perle, L.L.P.

(57) ABSTRACT

A door sweep for mounting to the bottom end of a door is disclosed. The door sweep has a mounting structure and at least one flexible sealing member extending from the mounting structure. When the door sweep is mounted to the door and the door is suspended within a door opening and is disposed in a closed position, the sealing member is disposed in sealing contact or substantially sealing contact with the bottom surface of the door opening. The mounting structure is provided with at least one groove configured for receiving and connecting with a second or replacement sealing member formed independently of the door sweep such that when the at least one sealing member is no longer able to provide a sealing effect with the bottom surface of the door opening, a second sealing member is disposed within and connected to the groove to provide the desired sealing effect.

31 Claims, 8 Drawing Sheets

DOOR SWEEP

FIELD

The present disclosure relates to door sweeps for mounting to the bottom end of a door that have one or more flexible sealing members for providing a sealing function between the bottom end of the door and the corresponding bottom surface of a door opening.

BACKGROUND

Door sweeps having flexible sealing members for mounting on a door are known. When the door sweep is mounted on a door that is suspended within a door frame defining a door opening, the flexible sealing member serves to provide a sealing function or sealing effect between the bottom end of the door and the corresponding bottom surface of the door opening when the door assumes its closed position. With the repeated opening and closing of the door, the flexible sealing member sweeps across the bottom surface of the door opening and, overtime, the flexible sealing member can wear-down, break, tear, etc. which damage can adversely affect the quality of sealing function provided by the door sweep and can entirely defeat the sealing function or sealing effect previously provided by the door. Accordingly, door sweeps that offer improved longevity which can help to ensure that an adequate sealing function or sealing effect is provided between the door and the corresponding bottom surface of a door opening are desirable.

SUMMARY

In one aspect, there is provided a door sweep, comprising:
a mounting structure configured for mounting to a door; and
a first sealing member extending from the mounting structure;
wherein the mounting structure includes a second sealing member-receiving groove for receiving a second sealing member for connecting to the mounting structure; and
the mounting structure and the first sealing member are a unitary, one-piece construction;
the mounting structure, the first sealing member, and the sealing member-receiving groove are co-operatively disposed such that:
(a) while the mounting structure is mounted to the door and the door is suspended within a door frame defining a door opening and is disposed in a closed position, the first sealing member is disposed in sealing contact or substantially sealing contact with a bottom surface of the door opening; and
(b) while the mounting structure is mounted to the door and the door is suspended within a door frame defining a door opening and is disposed in a closed position, and a second sealing member is received the second sealing member-receiving groove and is connected to the mounting structure, the second sealing member is disposed in sealing contact or substantially sealing contact with the bottom surface of the door opening.

In another aspect there is provided a door sweep, comprising:
a mounting structure configured for mounting to a door; and
a first sealing member extending from the mounting structure and disposed in a sealing-ready condition;
wherein the mounting structure includes a second sealing member-receiving groove for receiving a second sealing member for connecting to the mounting structure;
the mounting structure, the first sealing member, and the sealing member-receiving groove are co-operatively configured such that:
while the first sealing member is disposed in the sealing ready condition, and the mounting structure is mounted to the door and the door is suspended within a door frame defining a door opening and is disposed in a closed position, the first sealing member is disposed in the sealing-reading condition for effecting sealing contact, or substantially sealing contact, with a bottom surface of the door opening, and is interposed between the bottom surface and the second sealing member-receiving groove;
the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact or substantially sealing contact, of the first sealing member to the bottom surface is absent such that the sealing-ready condition is defeated; and
while the first sealing member is disposed in the damaged condition, the mounting structure is mounted to the door and the door is suspended within a door frame defining a door opening and is disposed in a closed position, and the second sealing member is connected to the mounting structure via the second sealing member-receiving groove, the second sealing is disposed for sealing contact, or substantially sealing contact, with the bottom surface while the mounting structure is mounted to the door and the door is suspended within a door frame and is disposed in a closed position.

In another aspect there is provided a door sweep, comprising:
a mounting structure configured for mounting to a door; and
a first sealing member extending from the mounting structure and disposed in a sealing-ready condition;
wherein
the mounting structure includes a second sealing member-receiving groove for receiving a second sealing member for connecting to the mounting structure;
the mounting structure, the first sealing member, and the second sealing member-receiving groove being co-operatively configured such that:
while the first sealing member is disposed in the sealing-ready condition, the mounting structure is mounted to the door, and the door is suspended within a door frame defining a door opening and is disposed in a closed position, the first sealing member is disposed in the sealing-ready condition for effecting sealing contact, or substantially sealing contact, with a bottom surface of the door opening and extends through a sealing member-occupied space;
the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact, or substantially sealing contact, of the first sealing member to the bottom surface is absent such that the sealing-ready condition is defeated; and while the first sealing member is disposed in the damaged condition, the mounting structure is mounted to the door, the door is suspended within a door frame defining a door opening and is disposed in a closed position, and the second sealing member is connected to the mounting structure, the second sealing member is:

(i) disposed for sealing contact, or substantially sealing contact, with the bottom surface while the mounting structure is mounted to the door and the door is suspended within a door frame defining a door opening and is disposed in a closed position; and (ii) extends through the sealing member-occupied space.

In another aspect there is provided a door assembly, comprising:

a door; and a door sweep mounted on the door, the door sweep comprising:

a mounting structure configured for mounting to a door; and a first sealing member extending from the mounting structure;

wherein the mounting structure includes a second sealing member-receiving groove for receiving a second sealing member configured for connecting to the mounting structure; and the mounting structure and the first sealing member are a unitary, one-piece construction;

the mounting structure, the first sealing member, and the sealing member-receiving groove are co-operatively configured such that:

(a) while the mounting structure is mounted to the door and the door is suspended within a door frame defining a door opening and is disposed in a closed position, the first sealing member is disposed in sealing contact or substantially sealing contact with a bottom surface of the door opening; and (b) while the mounting structure is mounted to the door and the door is suspended within a door frame defining a door opening and is disposed in a closed position, and a second sealing member is received within the second sealing member-receiving groove and is connected to the mounting structure, the second sealing member is disposed in sealing contact or substantially sealing contact with the bottom surface of the door opening.

In yet another aspect there is provided a door assembly, comprising:

a door; and a door sweep mounted on the door, the door sweep comprising:

a mounting structure configured for mounting to a door; and a first sealing member extending from the mounting structure and disposed in a sealing-ready condition;

wherein the mounting structure includes a second sealing member-receiving groove for receiving a second sealing member configured for connecting to the mounting structure;

the mounting structure, the first sealing member and the second sealing member-receiving groove being co-operatively configured such that:

while the first sealing member is disposed in the sealing-ready condition, the mounting structure is mounted to the door, and the door is suspended within a door frame defining a door opening and is disposed in a closed position, the first sealing member is disposed in the sealing-reading condition for effecting sealing contact, or substantially sealing contact, with a bottom surface of the door opening, and is interposed between the bottom surface and the second sealing member receiving groove;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact or substantially sealing contact, of the first sealing member to the bottom surface is absent such that the sealing-ready condition is defeated; and while the first sealing member is disposed in the damaged condition, the mounting structure is mounted to the door, and the door is suspended within a door frame defining a door opening and is disposed in a closed position, and the second sealing member is connected to the mounting structure via the second sealing member-receiving groove, the second sealing member is disposed for sealing contact, or substantially sealing contact, with the bottom surface while the mounting structure is mounted to the door and the door is suspended within a door frame and is disposed in a closed position.

In yet another aspect there is provided a door assembly, comprising:

a door; and a door sweep mounted on the door, the door sweep comprising:

a mounting structure configured for mounting to a door; and a first sealing member extending from the mounting structure and disposed in a sealing-ready condition;

wherein the mounting structure includes a second sealing member-receiving groove for receiving a second sealing member for connecting to the mounting structure;

the mounting structure, the first sealing member, and the second sealing member-receiving groove being co-operatively configured such that:

while the first sealing member is disposed in the sealing-ready condition, the mounting structure is mounted to the door, and the door is suspended within a door frame defining a door opening and is disposed in a closed position, the first sealing member is disposed in the sealing-ready condition for effecting sealing contact, or substantially sealing contact, with a bottom surface of the door opening and extends through a sealing member-occupied space;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact, or substantially sealing contact, of the first sealing member to the bottom surface is absent such that the sealing-ready condition is defeated; and while the first sealing member is disposed in the damaged condition, the mounting structure is mounted to the door, the door is suspended within a door frame defining a door opening and is disposed in a closed position, and the second sealing member is connected to the mounting structure, the second sealing member is:

(i) disposed for sealing contact, or substantially sealing contact, with the bottom surface while the mounting structure is mounted to the door and the door is suspended within a door frame defining a door opening and is disposed in a closed position; and (ii) extends through the sealing member-occupied space.

In yet another aspect there is provided a door sweep kit, comprising:

a mounting structure configured for mounting to a door, the mounting structure comprising:

a first sealing member extending from the mounting structure;

wherein the mounting structure and the first sealing member are a unitary, one-piece construction; and wherein the mounting structure includes a second sealing member-receiving groove for receiving a second sealing member configured for connecting to the mounting structure;

the mounting structure, the first sealing member, and the sealing member-receiving groove are co-operatively configured such that:

(a) while the mounting structure is mounted to a door and the door is suspended within a door frame defining a door opening and is disposed in a closed position, the first sealing member is disposed in sealing contact or substantially sealing contact with a bottom surface of the door opening; and (b) while the mounting structure is mounted to the door and the door is suspended within a door frame defining a door opening and is disposed in a closed position, and a second sealing member is received within the second sealing member-receiving groove and is connected to the mounting structure, the second sealing member is disposed in sealing contact or substantially sealing contact with the bottom surface of the door opening;

and a second sealing member for connecting to the second sealing member receiving groove, the second sealing member comprising:

engaging flanges;

a web portion; and a sealing surface-defining portion connected to the engaging flanges by the web portion.

In yet another aspect there is provided a door sweep kit, comprising:

a mounting structure configured for mounting to a door, the mounting structure comprising:

a first sealing member extending from the mounting structure and disposed in a sealing-ready condition;

wherein the mounting structure includes a second sealing member-receiving groove for receiving a second sealing member for connecting to the mounting structure;

the mounting structure, the first sealing member, and the second sealing member-receiving groove being co-operatively configured such that:

while the first sealing member is disposed in the sealing-ready condition, and the mounting structure is mounted to the door and the door is suspended within a door frame defining a door opening and is disposed in a closed position, the first sealing member is disposed in the sealing-reading condition for effecting sealing contact, or substantially sealing contact, with a bottom surface of the door opening, and is interposed between the bottom surface and the second sealing member-receiving groove;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact or substantially sealing contact, of the first sealing member to the bottom surface is absent such that the sealing-ready condition is defeated; and while the first sealing member is disposed in the damaged condition, the mounting structure is mounted to the door, the door is suspended within a door frame defining a door opening and is disposed in a closed position, and the second sealing member is connected to the mounting structure via the second sealing member-receiving groove, the second sealing member is disposed for sealing contact, or substantially sealing contact, with the bottom surface while the mounting structure is mounted to the door and the door is suspended within a door frame and is disposed in a closed position;

and at least one second sealing member for connecting to the second sealing member receiving groove, the second sealing member comprising:

engaging flanges;

a web portion; and a sealing surface-defining portion connected to the engaging flanges by the web portion.

In yet another aspect there is provided a door sweep kit, comprising:

a mounting structure configured for mounting to a door, the mounting structure comprising:

a first sealing member extending from the mounting structure and disposed in a sealing-ready condition;

wherein the mounting structure includes a second sealing member-receiving groove for receiving a second sealing member for connecting to the mounting structure;

the mounting structure, the first sealing member, and the second sealing member-receiving groove being co-operatively configured such that:

while the first sealing member is disposed in the sealing-ready condition, the mounting structure is mounted to the door, and the door is suspended within a door frame defining a door opening and is disposed in a closed position, the first sealing member is disposed in the sealing-ready condition for effecting sealing contact, or substantially sealing contact, with a bottom surface of the door opening and extends through a sealing member-occupied space;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact, or substantially sealing contact, of the first sealing member to the bottom surface is absent such that the sealing-ready condition is defeated; and while the first sealing member is disposed in the damaged condition, the mounting structure is mounted to the door, the door is suspended within a door frame defining a door opening and is disposed in a closed position, and the second sealing member is connected to the mounting structure, the second sealing member is:

(i) disposed for sealing contact, or substantially sealing contact, with the bottom surface while the mounting structure is mounted to the door and the door is suspended within a door frame defining a door opening and is disposed in a closed position; and (ii) extends through the sealing member-occupied space; and at least one second sealing member for connecting to the second sealing member receiving groove, the second sealing member comprising:

engaging flanges;

a web portion; and a sealing surface-defining portion connected to the engaging flanges by the web portion.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
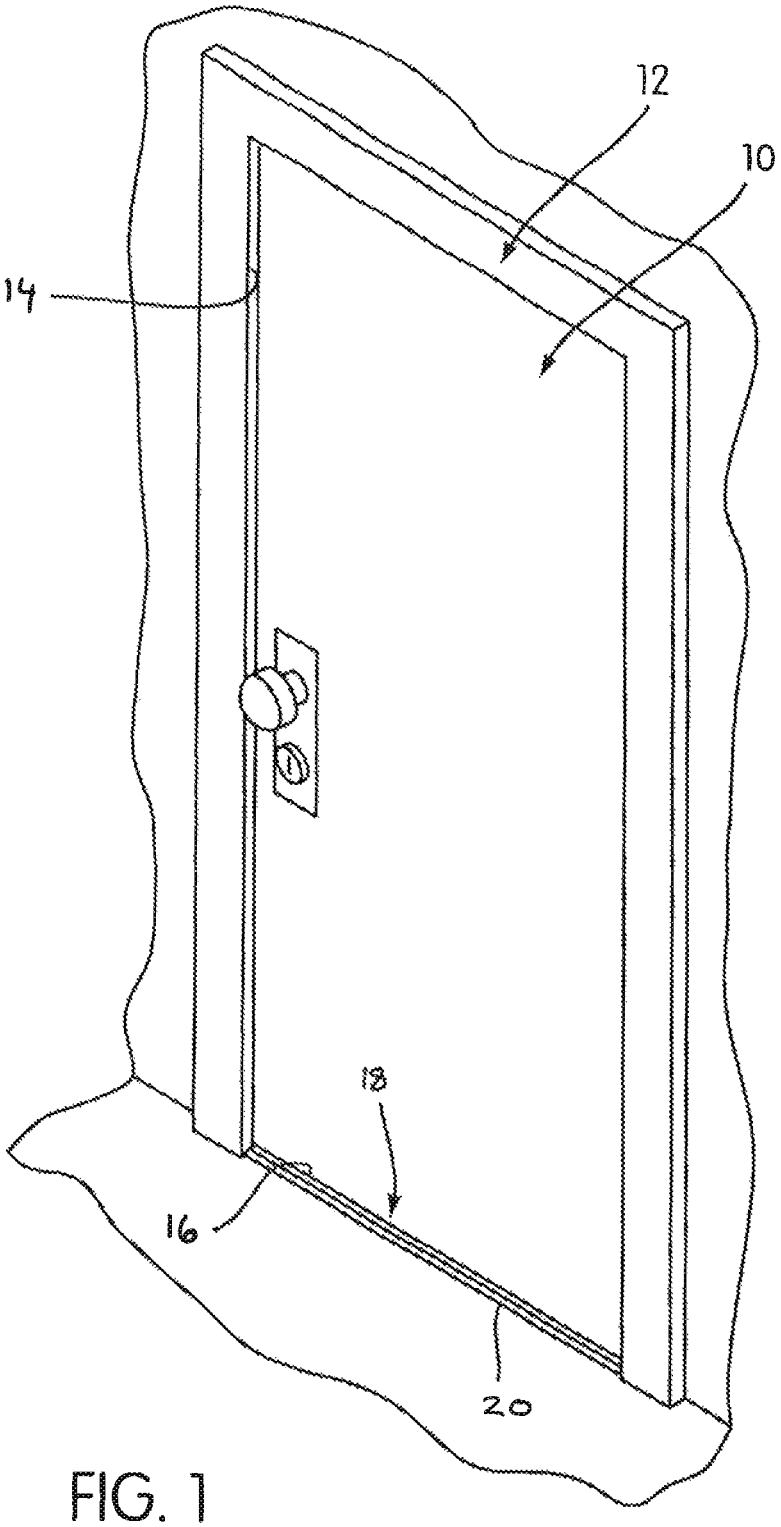
FIG. 1 is a perspective view of a door incorporating an example embodiment of a door sweep according to the present disclosure.

Referring now to FIG. 1 there is shown a door assembly comprising a door 10 suspended on a hinge or otherwise pivotally mounted within a door frame 12 which defines a door opening 14. A door sweep 16 is mounted on a bottom end 18 of the door 10 for providing a sealing function between the bottom of the door 10 and the corresponding bottom surface 20 of the door opening 14 when the door 10 is in a closed position. In some instances the bottom surface 20 of the door opening 14 may also be referred to as the threshold of the door opening 14 or door frame 12.

Figure 2:
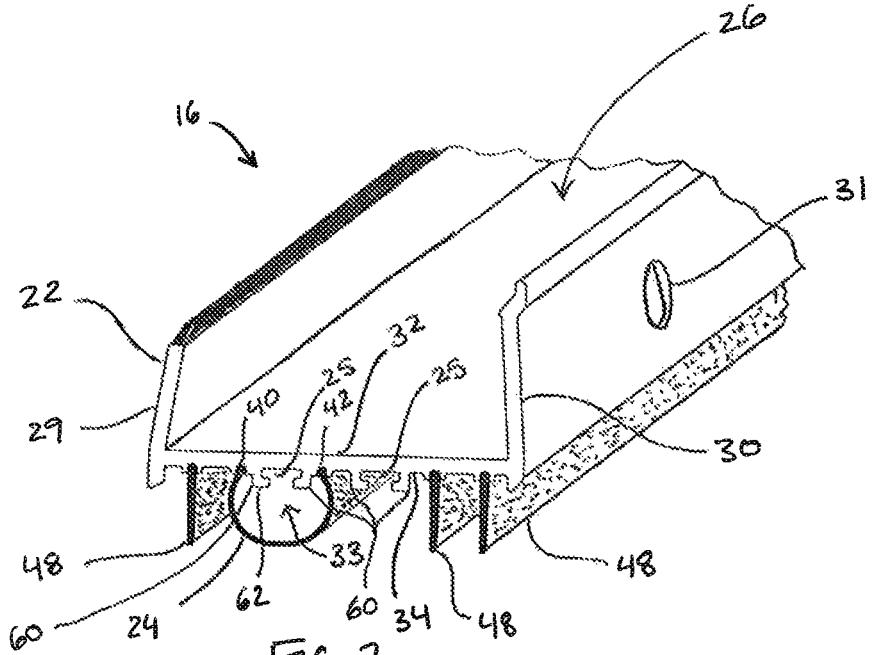
FIG. 2 is a partial, perspective view of an example embodiment of a door sweep according to the present disclosure.

FIG. 2 shows a door sweep 16 according to an example embodiment of the present disclosure. The door sweep 16 comprises a mounting structure 22 for mounting to the bottom end 18 of the door 10 and a first sealing member 24 extending from the mounting structure 22. The mounting structure 22 includes at least one second sealing-member receiving groove 25 for receiving a second sealing member configured for connecting to the mounting structure 22 via the second sealing-member receiving groove 25. In the subject example embodiment, the mounting structure and the first sealing member are a unitary, one-piece construction.

Figure 3:
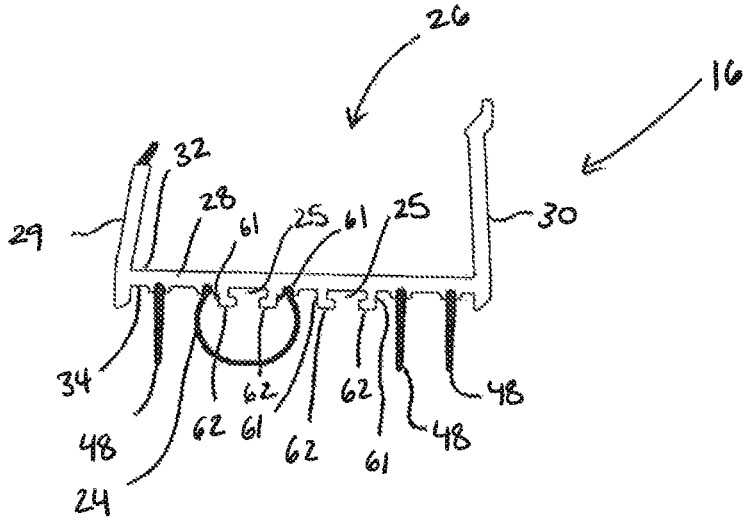
FIG. 3 is a cross-sectional view of the door sweep of FIG. 2.

In some embodiments, for example, the mounting structure 22 defines a channel 26 that is configured for receiving the bottom end 18 of the door 10. In some example embodiments, the channel 26 is defined by a base wall 28 and a pair of upstanding sidewalls 29, 30 such that when the door sweep 16 is mounted on the bottom end 18 of the door 10, the base wall 28 of the channel 26 has a first side 32 that abuts or is generally disposed so as to be in face-to-face contact with the bottom surface or bottom end surface 19 of the door 10. A second side 34 opposite to the first side 32 of the base wall 28 faces the bottom surface 20 of the door opening 14 when the door sweep 16 is mounted on the door 10 and the door is disposed in its closed position. The first sealing member 24 extends from the second side 34 of the base wall 28 of the door sweep 16 and the second sealing member-receiving groove 25 is disposed on the second side 34 of the base wall 28 of the mounting structure 22. Sidewalls 29, 30 overlap a bottom portion of the front 32 and rear surfaces 34 of the door 10, as shown in FIG. 3. While reference has been made to the front and rear surfaces 32, 34 of the door it will be understood that these terms are used as terms of convenience and are not intended to be limiting.

In some embodiments, for example, the channel 26 is sized for a snug or tight fit with the bottom end 18 of the door 10 although additional attachment means such as screws or any other suitable fasteners can be used to secure the door sweep 16 to the door 10. Accordingly, the sidewalls 29, 30 may be provided with a series of spaced apart fastener openings 31 through which any suitable fastener (not shown) may be inserted for securing the door sweep 16 to the door 10. The door sweep 16 can also be mounted to the bottom end 18 of the door 10 by any other suitable means known in the art, for instance the bottom end 18 of the door may be specifically adapted for interlocking with corresponding features on the door sweep 16 to ensure a secure mount.

In some embodiments, for example, the mounting structure 22 and the first sealing member 24 are co-extruded with the mounting structure 22 being formed from a first plastic material and the first sealing member 24 being formed from a second plastic material wherein the elastic modulus of the first plastic material is greater than the elastic modulus of the second plastic material. More specifically, in some embodiments, the first plastic material has an elastic modulus that is greater than the elastic modulus of the second plastic material by a multiple of at least 50, such as, for example, at least 100, such as, for example, at least 500, such as, for example, at least 1000.

In some embodiments, for example, the first sealing member 24 extends from a first connecting portion 40 of the mounting structure 22 to a second connecting portion 42 of the mounting structure 22, the first sealing member 24, therefore, extending between the first and second connecting portions 40, 42. Accordingly, as best seen in FIGS. 2 and 3, in such example embodiments, the first sealing member 24 is cooperatively configured with the mounting structure 22 so as to define an open interior space or cavity, or a sealing member-occupied space 33. In some example embodiments, the second sealing member-receiving groove 25 is disposed between the first connecting portion 40 and the second connecting portion 42 such that the second sealing member-receiving groove is disposed within the cavity 33.

When the door sweep 16 is mounted on the bottom end 18 of the door 10 and the door 10 pivots about its hinged mounting within the door frame 12, the mounting structure 22 and first sealing member 24 are disposed such that when the door 10 assumes its closed position, the first sealing member 24 is disposed in sealing contact, or substantially sealing contact, with the bottom surface 20 of the door opening 14. As the first sealing member 24 is formed of a generally flexible plastic material, the first sealing member 24 can deform about any irregularities or uneven portions of the bottom surface 20 of the door opening 14 or threshold as the door 10 assumes its closed position. Accordingly, the first sealing member 24 extends from the mounting structure 22 and is disposed in a sealing-ready condition for effecting sealing contact, or substantially sealing contact, with the bottom surface 22 when the mounting structure 22 is mounted on the door 10 and the door 10 is suspended within the door frame 12 defining the door opening 14 and the door is disposed in a closed position.

In some embodiments, for example, the sealing contact, or substantially sealing contact, with the bottom surface of the door is effected with a sealing surface of the first sealing member 24, wherein the sealing surface has a surface area of at least five (5) cubic inches, such as, for example, at least 7.5 cubic inches, such as, for example, at least ten (10) cubic inches.

In some embodiments, for example, the first sealing member 24 has a length, measured along a longitudinal axis, of at least 25 inches, such as, for example, at least 28 inches.

In some embodiments, for example, the mounting structure 22 comprises a further second sealing member-receiving groove 25 disposed on the second side 34 of the base wall 28 of the mounting structure channel 26, the second sealing member-receiving groove 25 being spaced-apart from the first sealing member 24.

The second sealing member-receiving groove 25 is configured for receiving a second sealing member 50 that is separate to and formed independently from the door sweep 16. The second sealing member-receiving groove 25 extends longitudinally along the mounting structure 22 and is shaped for receiving a first, engaging end 76 of the second sealing member 50, the first engaging end 76 comprising engaging flanges 80. Accordingly, the second sealing member-receiving groove 25 is configured such that once the second sealing member 50 has been received within the second sealing member-receiving groove 25, the second sealing member-receiving groove 25 functions to retain the second sealing member 50 in its connected relationship with the mounting structure 22 as the door 10 traverses the bottom surface 20. Therefore, while the second sealing member 50 is disposed within the second sealing member-receiving groove 25 and is connected to the mounting structure 22, the engaging flanges 80 are disposed within the groove 25 such that disconnection or removal of the second sealing member 50 from the mounting structure 22 is resisted by an opposing force induced by the second sealing member-receiving groove 25 on the engaging flanges 80 of the second sealing member 50 in response to, for example, a tensile force acting on the second sealing member 50.

The second sealing member 50 further comprises a second end defining a sealing surface 78 that is connected to the engaging flanges 80 by web portion 82. While the second sealing member 50 is disposed within the second sealing member-receiving groove 25 and the connection between the second sealing member 50 and the mounting structure 22 is being effected, the second sealing member 50 is disposed such that the axis of the web portion 82 is parallel, or substantially parallel, relative to a longitudinal axis of the door 10. Therefore, once the connection between the second sealing member 50 and the mounting structure 22 is effected, the second sealing member 50 is disposed for sealing contact, or substantially sealing contact, with the bottom surface 20 of the door opening 14 while the mounting structure is mounted to the door 10 and the door 10 is suspended within the door frame 12 defining the door opening 14 and is disposed in a closed position.

In some embodiments, for example, the second sealing member-receiving groove 25 is defined by a pair of spaced-apart projections 60 that extend from the mounting structure 22 and are formed from the same first plastic material as the mounting structure 22. In some embodiments, the projections 60 have a first portion 61 that extends from the second side 34 of the base wall 28 and a second portion 62 that extends orthogonally, or substantially orthogonally, relative to the first portion 61. When the second sealing member 50 is disposed within the second sealing member-receiving groove 25 and is thereby connected to the mounting structure 22, the engaging flanges 80 are disposed between the spaced apart first portions 61 of the projections 60 while the web portion 82 is disposed between the spaced apart second portions 62 of the projections 60. Accordingly, the second sealing member receiving groove 25 and the second sealing member 50 are cooperatively configured such that while the second sealing member 50 is disposed within the second sealing member receiving groove 25 and the connection to the mounting structure 22 is being effected, resistance to removal of the second sealing member 50 from the second sealing member-receiving groove 22 is effected by interaction between the second sealing member-receiving groove 25 and the engaging flanges 80. In the subject example embodiment, the second portions 62 of the projections 60 that define the second sealing member receiving groove 25 are disposed so as to generally oppose the engaging flanges 80 of the second sealing member 50, the second portions 62 opposing the engaging flanges 80 of the second sealing member 50 such that the second portions 62 interfere with removal of the second sealing member 50 from the second sealing member-receiving groove 25 by inducing an opposing force on the engaging flanges 80 in response to a tensile force applied along the axis of the web portion 82 of the second sealing member 50. Accordingly, the second sealing member-receiving groove 25 is shaped to receive the engaging flanges 80 such that while the second sealing member 50 is disposed within the second sealing member-receiving groove 25 and is connected to the mounting structure 22, the second sealing member receiving groove 25 retains the second sealing member 50 within the second sealing member-receiving groove 25 in response to forces that act on the second sealing member 50 as the door 10 traverse the bottom surface 20 of the door opening 14.

Figure 9:
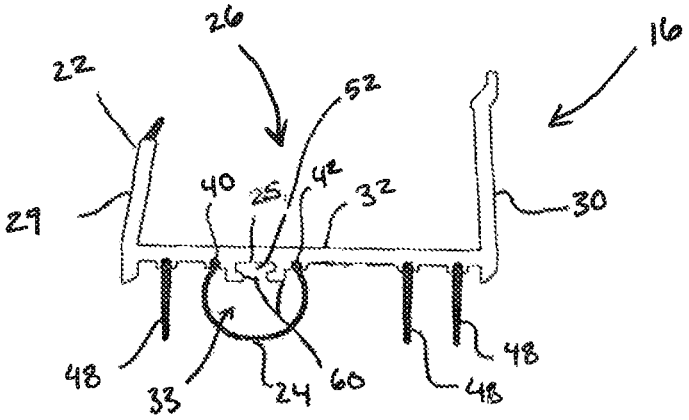
FIG. 9 is a cross-sectional view of another example embodiment of a door sweep according the present disclosure.
Figure 10:
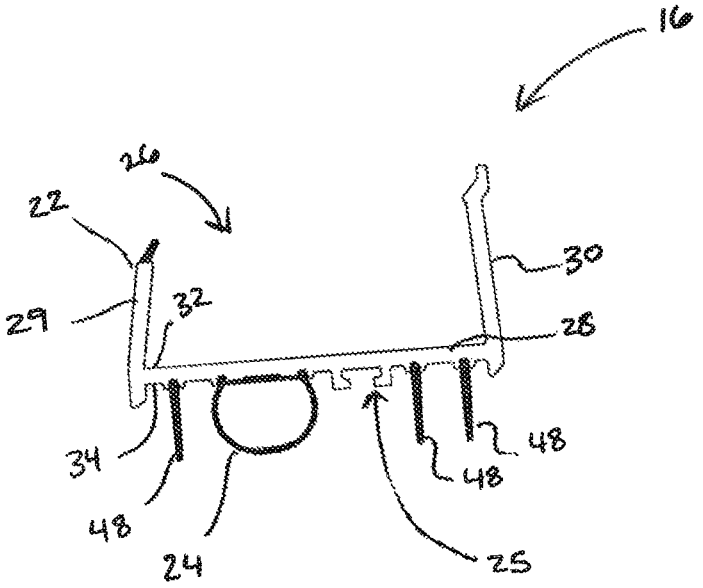
FIG. 10 is a cross-sectional view of another example embodiment of a door sweep according the present disclosure.

In some embodiments, for example as shown in FIGS. 2-8, the second sealing member-receiving groove 25 is disposed within the open interior space or cavity, or sealing-member occupied space 33 formed by the first sealing member 24 and the mounting structure 22, the second sealing member-receiving groove 25 being arranged intermediate the spaced apart first and second connecting portions 40, 42 of the first sealing member 24, and a further, second sealing member-receiving groove 25 is arranged spaced apart from the first sealing member 24. In other embodiments, for example, only one second sealing member-receiving groove 25 is provided as shown for instance in FIG. 9 wherein the second sealing member-receiving groove 25 is disposed within the open interior space or cavity, or sealing-member occupied space 33 formed by the first sealing member 24. In other embodiments, for example, the one, second sealing member-receiving groove 25 is disposed spaced apart from the first sealing member 24 as shown for instance in FIG. 10. In some embodiments, for example, the second sealing member groove 25 extends along, or substantially along, the central longitudinal axis of the second side 34 of the base wall 28 of the mounting structure channel 26.

In some embodiments, for example, the door sweep 16 further comprises one or more wiper elements 48 that extend from the mounting structure 22. The wiper elements 48 are formed from the same flexible plastic material, or second plastic material, as the first sealing member 24 and, in some embodiments, are co-extruded along with the mounting structure 22 and first sealing member 24. Accordingly, the wiper elements 48 extend from the mounting structure 22 by a first, connecting portion 72 and have a second, free end 74 disposed for sealing contact, or substantially sealing contact, with the bottom surface 20 the door opening 14 when a door 10 with the door sweep 16 mounted thereon moves across the bottom surface 20 of the door opening 14 and assumes its closed position.

In some embodiments, for example, a wiper element 48 extends longitudinally along the mounting structure 22 such that when the door sweep 16 is mounted on the bottom end 18 of the door 10 a first wiper element 48 is disposed slightly inset from the front surface of the door 10 while a second wiper element 48 is disposed slightly inset from the rear surface of the door 10. In some embodiments, for example, a third wiper element 48 is disposed at any point on the mounting structure 22 that is intermediate the first and second wiper elements 48, with the third wiper element 48 being spaced apart from the first sealing element 24 and the one or more sealing member-receiving groove(s) 25. While the example embodiments illustrated in FIGS. 2-10 show the door sweep 16 as being provided with three wiper elements 48, it will be understood that the exact number of wiper elements 48 and their specific arrangement on the mounting structure 22 may vary depending on the specific design and application of a particular door sweep 16.

Figure 4:
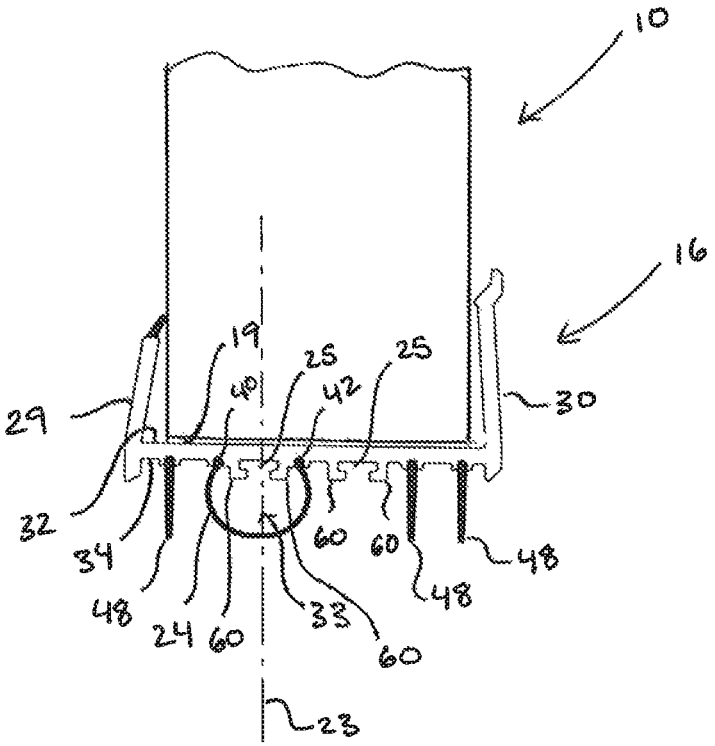
FIG. 4 is a longitudinal cross-sectional view of the door of FIG. 1 with the door sweep mounted thereon.
Figure 5:
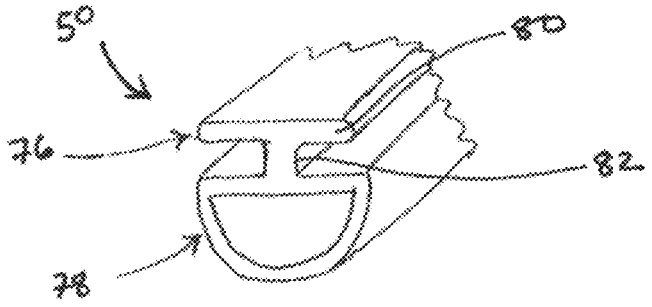
FIG. 5 is a partial, perspective view of a replacement sealing member for use with the door sweep of FIG. 2.

In use, with reference to FIG. 4, the door sweep 16 is mounted on the bottom end 18 of a door 10 and the door 10 is suspended within a door frame 12, the first sealing member 24 is disposed in a sealing-ready condition for effecting sealing contact, or substantially sealing contact, with the bottom surface 20 of the door opening 14. While the first sealing member 24 is disposed in the sealing ready condition, in some example embodiments, the sealing member-receiving groove 25 remains empty or unoccupied. Accordingly, while the mounting structure 22 is mounted to the door 10 and the door is suspended within the door frame 12 defining the door opening 14 and is disposed in a closed position, the first sealing member 24 is disposed in sealing contact or substantially sealing contact with the bottom surface 20 of the door opening 14. As well, while the mounting structure 22 is mounted to the door 10 and the door 10 is suspended within the door frame 12 defining the door opening 14 and is disposed in a closed position, and a second sealing member 50 is received within the second sealing member-receiving groove 25 and is connected to the mounting structure 22, the second sealing member 50 is disposed in sealing contact or substantially sealing contact with the bottom surface 20 of the door opening 14.

In some embodiments, for example when the second sealing member-receiving groove 25 is disposed within the open interior space or cavity 33 defined by the first sealing member 24 and the mounting structure 22, while the mounting structure 22 is mounted to the door 10 and the door is suspended within the door frame 12 defining the door opening 14 and is disposed in a closed position, the first sealing member 24 is disposed in sealing contact or substantially sealing contact with the bottom surface 20 of the door opening 14 with the first sealing member being interposed between the bottom surface 20 of the door opening 14 and the second sealing member-receiving groove 25. In other embodiments, for example, the first sealing member 24 extends through a sealing member-occupied space 33.

Overtime, however, the first sealing member 24 is susceptible to deterioration in response to the repeated movement across the bottom surface 20 of the door opening 14 with the effect that the first sealing member 24 may break or tear, etc. and, therefore, become disposed in a damaged condition 24' such that while the mounting structure 22 is mounted to the door 10, and the door 10 is suspended within a door frame 12 and is disposed in a closed position, the desired sealing function, namely the sealing contact, or substantially sealing contact, of the first sealing member 24, to the bottom surface 20 of the door opening 14 is absent such that the sealing-ready condition is defeated.

Figure 6:
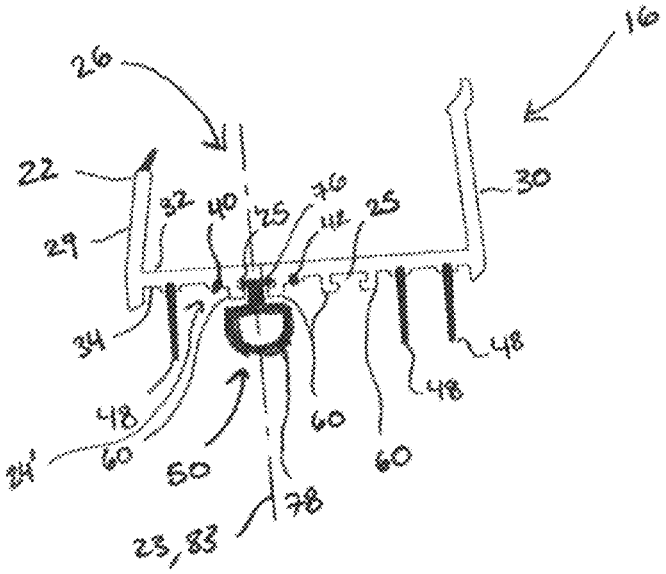
FIG. 6 is a cross-sectional view of the door sweep incorporating the replacement sealing member of FIG. 5.
Figure 7:
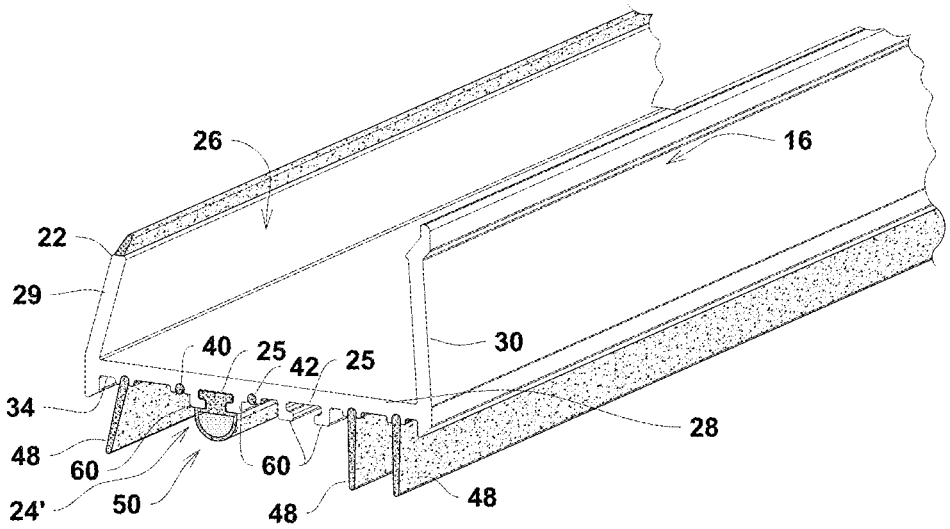
FIG. 7 is a partial, perspective view of the door sweep of FIG. 6.
Figure 8:
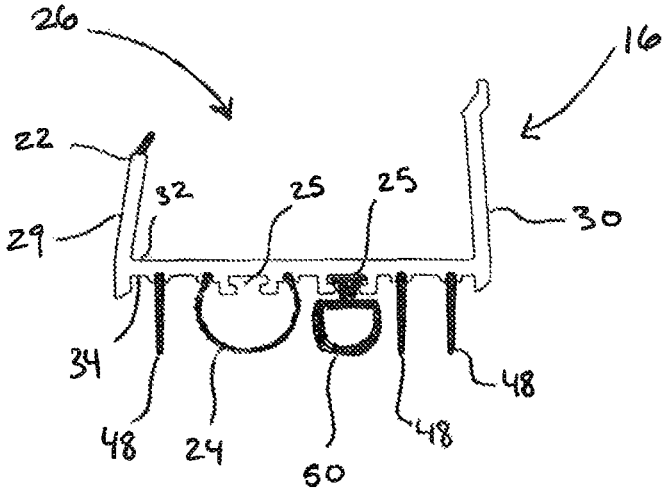
FIG. 8 is a cross-sectional view of another example embodiment of the door sweep according the present disclosure incorporating the replacement sealing member of FIG. 5.

In some embodiments, for example, it is while the first sealing member 24 is disposed in the damaged condition that the second sealing member-receiving groove 25 is disposed for receiving the second sealing member 50 for effecting a connected relationship between the second sealing member 50 and the mounting structure 22, as shown for instance in FIG. 6, with effect that the second sealing member 50 is disposed for sealing contact or substantially sealing contact with the bottom surface 20 of the door opening 14 while the mounting structure is mounted to the door and the door is suspended within a door frame 12 defining a door opening 14 and is disposed in a closed position. Accordingly, the door sweep 16 is able to continue to provide the desired sealing function between the door sweep 16 and the bottom surface 20 of the door opening 14 even when the sealing effect previously provided by the sealing-ready condition of the first sealing member 24 is defeated.

In some embodiments, when the sealing-ready condition of the first sealing member 24 is defeated and the first sealing member 24 is no longer able to provide the desired sealing effect, the remaining portions of the first sealing member 24 may be removed, or substantially removed, from the mounting structure 22 thereby providing unobstructed, or substantially unobstructed, access to the sealing member-receiving groove 25 disposed within the open interior space 33 previously defined by the first sealing member 24. While the majority of the first sealing member 24 may be removed, the first and second connecting portions 40, 42 of the first sealing member 24 may remain encapsulated or embedded within the mounting structure 22 or otherwise affixed thereto.

With the deterioration of the first sealing member 24, the second sealing member-receiving groove 25 becomes disposed for receiving the second sealing member 50 with the engaging flanges 80 being received within the second sealing member-receiving groove 25 and, in some embodiments, disposed between the spaced-apart projections 60. With the engagement of the engaging flanges 80 within the second sealing member-receiving groove 25, the sealing surface portion 82 of the second sealing member 50 is disposed in a sealing-ready condition. Accordingly, while the second sealing member 50 is disposed within and connected to the second sealing member-receiving groove 25, the second sealing member 50 is able to provide the desired sealing effect between the door sweep 16 and the bottom surface 20 of the door opening 14 when the door 10 assumes it closed position that was previously achieved by the first sealing member 24.

In other instances where the door sweep 16 is provided with a second sealing member-receiving groove 25 that is disposed spaced apart from the first sealing member 24, deterioration of the first sealing member 24 is not necessarily required in order for the sealing member-receiving groove 25 to be disposed for receiving a second sealing member 50. Accordingly, in some instances a second sealing member 50 can be disposed within and connected to a second sealing member receiving groove 25 prior to deterioration and/or removal of the first sealing member 24, as shown for instance in FIG. 8. In other instances, a second sealing member 50 can be disposed within and connected to each of the respective second sealing member-receiving grooves 25 upon deterioration of the first sealing member 24.

In accordance with some example embodiments, the door sweep 16 is pre-mounted on to a door 10, with the door 10 and door sweep 16 together being provided as a unit or door assembly 100.

In accordance with some example embodiments, the door sweep 16 is part of a door sweep kit comprising any one of the example embodiments of the door sweep 16 disclosed in the present disclosure along with a replacement sealing member in the form of a second sealing member 50.

While various example embodiments have been described, it will be understood that certain adaptations and modifications of the described embodiments can be made. Therefore, the above discussed embodiments are considered to be illustrative and not restrictive.

What is claimed is:

1. A door sweep, comprising:

a mounting structure configured for mounting to a door; and a first sealing member extending from the mounting structure;

wherein the mounting structure includes a second sealing member-receiving groove for receiving a second sealing member for connecting to the mounting structure; and the mounting structure and the first sealing member are a unitary, one-piece construction;

the mounting structure, the first sealing member, and the sealing member-receiving groove are co-operatively configured such that:

while the mounting structure is mounted to the door and the door is suspended within a door frame defining a door opening and is disposed in a closed position, the first sealing member is disposed in sealing contact, or substantially sealing contact, with a bottom surface of the door opening; and while the mounting structure is mounted to the door and the door is suspended within a door frame defining a door opening and is disposed in a closed position, and a second sealing member is received within the second sealing member-receiving groove and is connected to the mounting structure, the second sealing member is disposed in sealing contact or substantially sealing contact with the bottom surface of the door opening;

wherein:

while the mounting structure is mounted to the door and the first sealing member is disposed for effecting sealing contact, or substantially sealing contact, with the bottom surface of the door opening, and is disposed in a closed position, the door is disposed in a sealing-ready condition;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame and is disposed in a closed position, the sealing contact or substantially sealing contact, of the first sealing member to the bottom surface is absent such that the sealing-ready condition is defeated; and the first sealing member and the sealing member-receiving groove are cooperatively configured such that while the sealing-ready condition is defeated, the second sealing member-receiving groove is disposed for receiving the second sealing member for effecting a connected relationship between the second sealing member and the mounting structure with effect that the second sealing member is disposed for sealing contact, or substantially sealing contact, with the bottom surface while the mounting structure is mounted to the door and the door is suspended within a door frame and is disposed in a closed position.

2. The door sweep as claimed in claim 1, wherein the mounting structure and the first sealing member are co-extruded.

3. The door sweep as claimed in claim 2, wherein the mounting structure includes a first plastic material and the first sealing member includes a second plastic material, wherein the elastic modulus of the first plastic material is greater than the elastic modulus of the second plastic material.

4. The door sweep as claimed in claim 3, wherein the elastic modulus of the first plastic material is greater than the elastic modulus of the second plastic material by a multiple of at least 50.

5. The door sweep as claimed in claim 3, wherein the elastic modulus of the first plastic material is between about 1500 and about 3000 MPa and the elastic modulus of the second plastic material is between about 1.5 and about 15 MPa.

6. The door sweep as claimed in claim 1, wherein the mounting structure comprises a channel for receiving the door.

7. The door sweep as claimed in claim 1, wherein the second sealing member-receiving groove is disposed spaced apart from the first sealing member.

8. A door sweep, comprising:

a mounting structure configured for mounting to a door; and a first sealing member extending from the mounting structure and disposed in a sealing-ready condition;

wherein:

the mounting structure includes a second sealing member-receiving groove for receiving a second sealing member for connecting to the mounting structure;

the mounting structure, the first sealing member, and the second sealing member-receiving groove being co-operatively configured such that:

while the first sealing member is disposed in the sealing-ready condition, and the mounting structure is mounted to the door and the door is suspended within a door frame defining a door opening and is disposed in a closed position, the first sealing member is disposed in the sealing-reading condition for effecting sealing contact, or substantially sealing contact, with a bottom surface of the door opening, and is interposed between the bottom surface and the second sealing member-receiving groove;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact or substantially sealing contact, of the first sealing member to the bottom surface is absent such that the sealing-ready condition is defeated; and while the first sealing member is disposed in the damaged condition, the mounting structure is mounted to the door, the door is suspended within a door frame defining a door opening and is disposed in a closed position, and the second sealing member is connected to the mounting structure via the second sealing member-receiving groove, the second sealing member is disposed for sealing contact, or substantially sealing contact, with the bottom surface while the mounting structure is mounted to the door and the door is suspended within a door frame and is disposed in a closed position.

9. The door sweep as claimed in claim 8, wherein the mounting structure and the first sealing member are a unitary, one-piece construction.

10. The door sweep as claimed in claim 8, wherein the mounting structure and the first sealing member are co-extruded.

11. The door sweep as claimed in claim 10, wherein the mounting structure includes a first plastic material and the first sealing member includes a second plastic material, wherein the elastic modulus of the first plastic material is greater than the elastic modulus of the second plastic material.

12. The door sweep as claimed in claim 11, wherein the elastic modulus of the first plastic material is greater than the elastic modulus of the second plastic material by a multiple of at least 50.

13. The door sweep as claimed in claim 11, wherein the elastic modulus of the first material is between about 1500 and about 3000 MPa and the elastic modulus of the second plastic material is between about 1.5 and about 15 MPa.

14. The door sweep as claimed in claim 8, wherein the second sealing member-receiving groove is aligned with the first sealing member.

15. The door sweep as claimed in claim 8, wherein:

the sealing contact, or substantially sealing contact, with the bottom surface of the door is effected with a sealing surface of the first sealing member, wherein the sealing surface has a surface area of at least five (5) cubic inches.

16. The door sweep as claimed in claim 8, wherein:

the first sealing member has a length, measured along a longitudinal axis, of at least 25 inches.

17. The door sweep as claimed in claim 8, wherein:

the first sealing member extends from a first connecting portion of the mounting structure to a second connecting portion of the mounting structure, and the second sealing member-receiving groove is disposed between the first connecting portion and the second connecting portion.

18. The door sweep as claimed in claim 17, wherein:

the first sealing member and the mounting structure are cooperatively configured to define a cavity between the first connecting portion and the second connecting portion, and the second sealing member-receiving groove is disposed within the cavity.

19. The door sweep as claimed in claim 8, wherein the mounting structure comprises a channel for receiving the door.

20. A door sweep, comprising:

a mounting structure configured for mounting to a door; and a first sealing member extending from the mounting structure and disposed in a sealing-ready condition;

wherein the mounting structure includes a second sealing member-receiving groove for receiving a second sealing member for connecting to the mounting structure;

the mounting structure, the first sealing member, and the second sealing member-receiving groove being co-operatively configured such that:

while the first sealing member is disposed in the sealing-ready condition, the mounting structure is mounted to the door, and the door is suspended within a door frame defining a door opening and is disposed in a closed position, the first sealing member is disposed in the sealing-ready condition for effecting sealing contact, or substantially sealing contact, with a bottom surface of the door opening and extends through a sealing member-occupied space;

the first sealing member is susceptible to deterioration in response to repeated movement across the bottom surface with effect that the first sealing member becomes disposed in a damaged condition such that, while the first sealing member is disposed in the damaged condition and the mounting structure is mounted to the door and the door is suspended within a door frame defining a door opening and is disposed in a closed position, the sealing contact, or substantially sealing contact, of the first sealing member to the bottom surface is absent such that the sealing-ready condition is defeated; and while the first sealing member is disposed in the damaged condition, the mounting structure is mounted to the door, the door is suspended within a door frame defining a door opening and is disposed in a closed position, and the second sealing member is connected to the mounting structure, the second sealing member is:

(i) disposed for sealing contact, or substantially sealing contact, with the bottom surface while the mounting structure is mounted to the door and the door is suspended within a door frame defining a door opening and is disposed in a closed position; and (ii) extends through the sealing member-occupied space.

21. The door sweep as claimed in claim 20, wherein the mounting structure and the first sealing member are a unitary, one-piece construction.

22. The door sweep as claimed in claim 20, wherein the mounting structure and the first sealing member are co-extruded.

23. The door sweep as claimed in claim 22, wherein the mounting structure includes a first plastic material and the first sealing member includes a second plastic material, wherein the elastic modulus of the first plastic material is greater than the elastic modulus of the second plastic material.

24. The door sweep as claimed in claim 23, wherein the elastic modulus of the first plastic material is greater than the elastic modulus of the second plastic material by a multiple of at least 50.

25. The door sweep as claimed in claim 23, wherein the elastic modulus of the first material is between about 1500 and about 3000 MPa and the elastic modulus of the second plastic material is between about 1.5 and about 15 MPa.

26. The door sweep as claimed in claim 20, wherein the second sealing member-receiving groove is aligned with the first sealing member.

27. The door sweep as claimed in claim 20, wherein:

the sealing contact, or substantially sealing contact, with the bottom surface of the door is effected with a sealing surface of the first sealing member, wherein the sealing surface has a surface area of at least five (5) cubic inches.

28. The door sweep as claimed in claim 20, wherein:

the first sealing member has a length, measured along a longitudinal axis, of at least 25 inches.

29. The door sweep as claimed in claim 20, wherein:

the first sealing member extends from a first connecting portion of the mounting structure to a second connecting portion of the mounting structure, and the second sealing member-receiving groove is disposed between the first connecting portion and the second connecting portion.

30. The door sweep as claimed in claim 29, wherein:

the first sealing member and the mounting structure are cooperatively configured to define a cavity between the first connecting portion and the second connecting portion, and the second sealing member-receiving groove is disposed within the cavity.

31. The door sweep as claimed in claim 20, wherein the mounting structure comprises a channel for receiving the door.

* * * * *